US005788327A

United States Patent [19]

Gregory

[11] Patent Number: 5,788,327

[45] Date of Patent: Aug. 4, 1998

[54] HANGING CHAIR

[76] Inventor: Alexander L. Gregory, HCR 32 Box 420, Bath, Me. 04530

[21] Appl. No.: 614,897

[22] Filed: Mar. 13, 1996

[51] Int. Cl.[6] ..... A47D 13/10

[52] U.S. Cl. ..... 297/273; 297/408; 297/423.3

[58] Field of Search ..... 297/273, 277, 297/278, 279, 391, 408, 403, 423.1, 423.26, 423.3, 397; 472/118, 122, 123

[56] References Cited

U.S. PATENT DOCUMENTS

| | | | |
|---|---|---|---|
| 427,900 | 5/1890 | Pearson | 297/273 X |
| 491,172 | 2/1893 | Hart | 297/279 X |
| 711,221 | 10/1902 | Manning et al. | 472/123 X |
| 787,556 | 4/1905 | Bottgar | 297/279 X |
| 1,189,393 | 7/1916 | Shaw | 297/277 X |
| 1,368,146 | 2/1921 | Hayes | 472/122 |
| 1,839,579 | 1/1932 | Murray | 297/277 |
| 5,374,107 | 12/1994 | Schuitzler | 297/273 |

*Primary Examiner*—Milton Nelson, Jr.
*Attorney, Agent, or Firm*—William Nitkin

[57] ABSTRACT

A hanging chair which includes a substantially rectangular primary frame having a seat portion pivotally connected to a back portion and a sheet of material stretched between and attached to the frame for supporting a user in a reclined, seated position is disclosed. The hanging chair also includes a hanger bar having a cam cleat attachment which adjustably secures the hanger bar to a chair support cord which attaches to an overhead support. The cam cleat attachment allows the vertical position of the hanger bar and the chair to be adjusted along the chair support cord. In addition, in one embodiment, first and second side support cords are attached to the frame and are hung from the hanger bar with pulleys which allow the side support cords to slide on the hanger bar, thereby adjusting the incline of the frame. First and second central support cords are attached to the seat portion of the frame and are adjustably attached to the hanger bar with jam cleats which allow the central support cords to be raised or lowered, thereby adjusting the relative incline between the seat portion and back portion of the frame. In a further embodiment the side support cords can be separately and adjustably attached to the hanger bar independently from each other. The hanging chair also can include an adjustable foot rest and an adjustable head rest.

6 Claims, 6 Drawing Sheets

HANGING CHAIR

BACKGROUND OF THE INVENTION

1. Field of the Invention

This invention resides in the area of chairs and more particularly relates to an adjustable hanging chair.

2. Description of the Prior Art

A great many hanging chairs, swings, baskets and hammocks have been designed. Most tend to be similar to a conventional chair with a rigid seat and back, and hung from overhead cables. These types of hanging chairs fail to combine comfort with easy adjustability. Typical of such hanging chairs are those disclosed U.S. Pat. No. 4,304,437 to Longo and U.S. Pat. No. 285,665 to Peck.

Hammocks of various types have the advantage of soft, flexible seating. However, they are usually more bed-like than chair-like and do not provide comfortable upright seating. In addition, they do not provide easy adjustability or reverse inclination for further relaxation of the body. One such hammock chair is disclosed in U.S. Pat. No. 303,551 to Arnold.

Thus there is a continuing need for improved hanging chairs overcoming the above-noted shortcomings and providing improved comfort, relaxation and adjustability.

SUMMARY OF THE INVENTION

One object of the present invention, therefore, is to provide an adjustable hanging chair that has soft, flexible seating which is infinitely adjustable, is compact, lightweight and easily manufactured and operated.

Another object of the present invention is to provide an adjustable hanging chair that can be raised or lowered and has an adjustable incline including a reverse incline which is helpful for relaxing the body.

Yet another object of the present invention is to provide an adjustable hanging chair having an adjustable foot rest and adjustable head rest.

Still yet another object is to provide an adjustable hanging chair having a back portion and a seat portion with the relative incline therebetween being adjustable. When disposed in a reverse inclined mode, the foot rest of the chair can be higher than the headrest. The seat and back adjustments can also be independent of one another.

Yet still another object is to provide an adjustable hanging chair that can be adjusted in each of the ways described above by a user while actually sitting in the adjustable hanging chair of this invention.

The above objects and others are provided for in accordance with this invention by a hanging chair which includes a generally rectangular primary frame, a chair support cord, a hanger bar and first and second side support cords. The primary frame has a first side piece, a second side piece, a top piece and a bottom piece, with each side piece having a top end and a bottom end. The primary frame also includes a generally rectangular sheet of material stretching between all four pieces and attached to the primary frame with the primary frame and the sheet of material, in combination, supporting a user in a reclined seated position.

The hanging chair is supported by hanging means from an overhead support, such as a ceiling beam, tree limb or sailboat rigging; and the chair support cord attaches to the hanging means.

The hanger bar includes an adjustable securing means for adjustably securing the hanger bar to the chair support cord.

This arrangement allows the vertical position of the hanger bar to be adjusted up or down by attaching the hanger bar at different positions along the length of the chair support cord, providing improved comfort for relaxation and adjustability.

The first side support cord has a first end attaching to the top end of the first side piece of the primary frame, and a second end attaching to the bottom end of the first side piece of the primary frame. The second side support cord has a first end attaching to the top end of the second side piece of the primary frame and a second end attaching to the bottom end of the second side piece of the primary frame.

A first low-friction attachment means attaches to the first end of the hanger bar with the first side support cord passing therethrough. The first low-friction attachment means, therefore, supports the first side support cord on the hanger bar yet allows the cord to freely pass therebetween. A second low-friction attachment means similarly attaches the second side support cord to the second end of the hanger bar yet allows this cord to pass freely therethrough. The low-friction attachment means allow the side support cords to move on the hanger bar to adjust the angle of incline of the primary frame.

A front first stop cord attaches to the hanger bar and adjustably attaches to the first side support cord between the second end of the first side support cord and the first low-friction attachment means. A front second stop cord attaches to the hanger bar and adjustably attaches to the second side support cord between the second end of the second side support cord and the second low-friction attachment means. The front stop cords prevent the primary frame from rotating forward beyond a preselected point determined by where the front stop cords are attached to the side support cords.

A back first side stop cord attaches to the hanger bar and adjustably attaches to the first side support cord between the first end of the first side support cord and the first low-friction attachment means. A back second side stop cord attaches to the hanger bar and adjustably attaches to the second side support cord between the first end of the second side support cord and the second low-friction attachment means. The back stop cords prevent the primary frame from rotating backward beyond a preselected point determined by where the back stop cords are attached to the side support cords.

In another embodiment of this invention the hanging chair can include additionally a back portion of the primary frame, a seat portion of the primary frame, and a first and second central support cord. In this embodiment the first and second side pieces of the primary frame further include a similarly located first and second break between the top end and the bottom end of each side piece. The portion of the primary frame between the breaks and the top piece forms the back portion of the primary frame while the portion of the primary frame between the breaks and the bottom piece forms the seat portion of the primary frame, with the seat portion pivotally connecting to the back portion. The first central support cord attaches to the first side piece of the seat portion of the primary frame with a first adjustable attachment means adjustably attaching the first central support cord to the hanger bar. The second central support cord attaches to the second side piece of the seat portion of the primary frame with a second adjustable attachment means adjustably attaching the second central support cord to the hanger bar, such arrangement allowing the central support cords to be raised or lowered to control the relative angle of incline between the seat portion and the back portion of the primary frame.

In the present invention the hanging chair also includes a foot rest and a head rest. A first foot rest support loop adjustably attaches to the first side support cord between the first low-friction attachment means and the front first side stop cord. A second foot rest support loop adjustably attaches to the second side support cord between the second low-friction attachment means and the front second side stop cord, whereby the first and second foot rest loops support the user's feet on the foot rest.

The foot rest pivotally connects to the primary frame adjacent to the bottom piece with the first and second foot rest support loops attaching to the foot rest whereby the incline of the foot rest can be adjusted by moving the first and second foot rest support loops along, respectively, the first and second side support cords.

The head rest includes head rest attachment means for removably, adjustably and pivotally attaching the head rest to the back portion of the primary frame so that the head rest lies above the top piece of the back portion of the primary frame. A first head rest support cord adjustably attaches to the first side support cord between the back first side stop cord and the top piece of the primary frame. A second head rest support cord adjustably attaches to the second side support cord between the back second side stop cord and the second side of the top piece of the primary frame, whereby the incline of the head rest can be adjusted by moving the first and second head rest cords along, respectively, the first and second side support cords.

In yet another embodiment the side support cords extending on each side to the seat portion and back portion can each be separately and independently controlled from one another as well as each central support cord, thereby eliminating the need for stop cords and thus simplifying the adjustment. The user can adjust each of these three sets of cords independently by means of a series of pulleys and jam cleats disposed on a pair of support members, each forming a multiple jam cleat attachment member and each disposed under its respective end of the hanger bar. This embodiment also comes with foot and head rests as previously described.

In summary, the present invention in its several embodiments provides a hanging chair that is easily operated, lightweight, compact and can be folded for storage or for easy carrying. In addition, the present invention provides a hanging chair that has an adjustable angle of inclination and can also be adjusted vertically. The present invention also has an adjustable head rest and foot rest, and a back portion and seat portion having an adjustable relative angle of inclination. Furthermore, all of the possible adjustments can be made by a user while actually sitting in the hanging chair.

DESCRIPTION OF THE PREFERRED EMBODIMENT(S)

Figure 1:
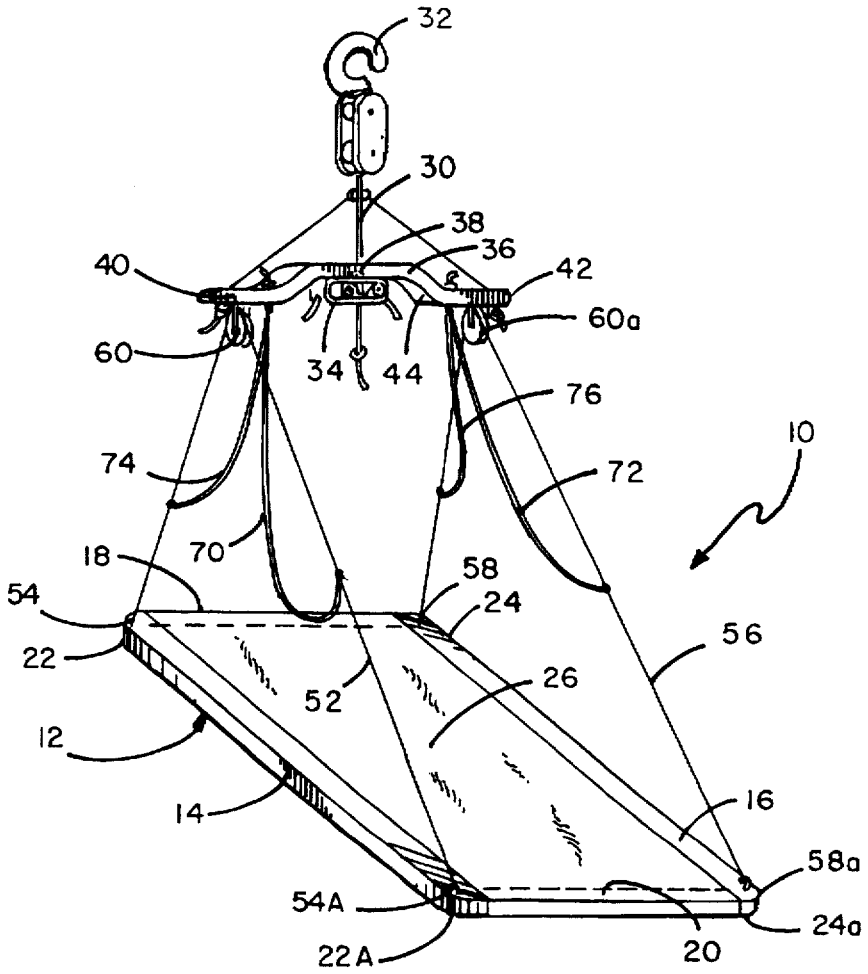
FIG. 1 illustrates a perspective side view of one embodiment of the hanging chair of this invention.

FIG. 1 illustrates one embodiment of hanging chair 10 having a generally rectangular primary frame generally represented by the reference numeral 12, a chair support cord 30, a hanger bar 36, and a first and second side support cords 52 and 56.

Primary frame 12 has first side piece 14, second side piece 16, top piece 18 and bottom piece 20 with first and second side pieces 14 and 16 having, respectively, a first and second top end 22 and 24 and a first and second bottom end **22*a* and 24*a*. Primary frame 12 can be made of wood, aluminum, plastic, carbon fiber or other lightweight, sturdy material. A generally rectangular sheet 26 of material stretches between all four pieces and attaches to primary frame 12. Sheet 26 of material can be made of canvas, leather, rubber, plywood and netting or another material having similar stength and flexibility properties to enable the material in combination with primary frame 12 to support a user in a reclined, seated position. Sheet 26 of material can be strung to primary frame 12**, but also can be attached in other ways such as, for example, by gluing or by being sewn together around the primary frame.

A hook 32 comprises a hanging means that can be removably attached to an overhead support such as a tree limb, not shown, such as a ceiling beam or sail boat rigging, while the chair support cord 30 attaches to hook 32. Alternately, the hanging means can comprise a free-standing hanger or brace. In fact, chair support cord 30 could also be tied directly to an overhead support such as a tree limb, ceiling beam or sailboat rigging, not shown.

Hanger bar 36 includes a central aperture 38, a first end 40, a second end 42 and a bottom 44 with chair support cord 30 extending through aperture 38 to bottom 44. Hanger bar 36 further includes an adjustable securing means 34 located on bottom 44 adjacent to aperture 38 for adjustably securing hanger bar 36 to chair support cord 30. This arrangement allows the vertical position of hanger bar 36 to be adjusted upward or downward by attaching hanger bar 36 at different positions along the length of chair support cord 30.

Figure 4:
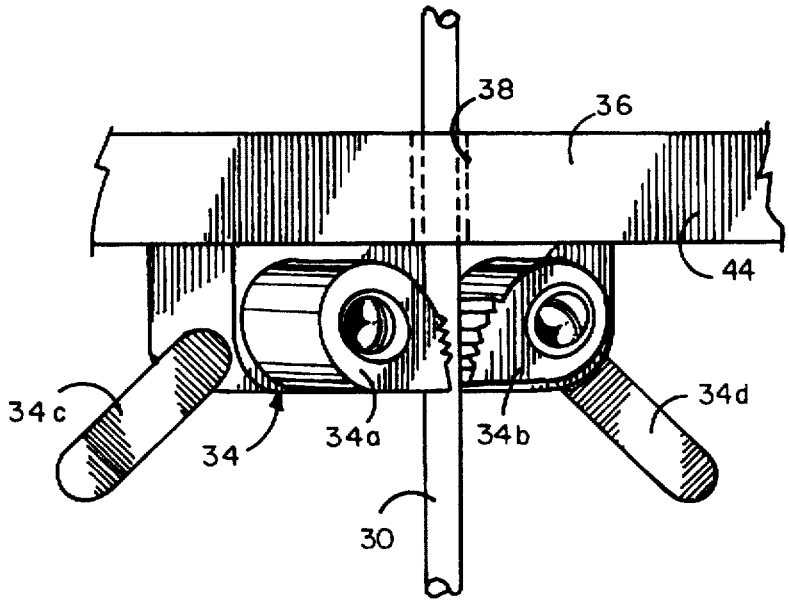
FIG. 4 illustrates a perspective view of a cam cleat attachment member.

The adjustable securing means comprises a cam cleat attachment member 34 seen in FIG. 4. Cam cleat attachment member 34 includes two oppositely oriented first and second cam rollers **34*a* and 34*b*, positioned side by side, which rollers allow chair support cord 30 located therebetween to pass downwardly but prevent cord 30 from passing upwardly. To raise hanger bar 36, chair support cord 30 is pulled down through aperture 38 and between first and second cam rollers 34*a* and 34*b* which action then holds hanger bar 36 in position by preventing chair support cord 30 from sliding back through first and second cam rollers 34*a* and 34*b*. To lower hanger bar 36, chair support cord 30 is pulled out from between first and second cam rollers 34*a* and 34*b* and allowed to slide up through aperture 38**.

Once hanger bar 36 is lowered or raised to a desired position, chair support cord 30 is then pulled back between first and second cam rollers **34*a* and 34*b* which action then secures hanger bar 36 in position by preventing chair support cord 30 from sliding back up through aperture 38**.

Cam cleat attachment member 34 also includes first and second standard cleats **34*c* and 34*d*. Any extra chair support cord hanging between first and second cam rollers 34*a* and 34*b* can be wrapped around first and second cleats 34*c* and 34*d*. The benefit of cam cleat attachment member 34 is that the height of hanger bar 36 and hanging chair 10 can be adjusted by a user while actually sitting in hanging chair 10**.

Referring back to FIG. 1, it will be seen that first side support cord 52 has a first end 54 attached to top end 22 of first side piece 14 of primary frame 12, and second end **54*a* is attached to bottom end 22*a* of first side piece 14 of primary end 12. Second side support cord 56 has its first end 58 attached to top end 24 of second side piece 16 of primary frame 12, and second end 58***a* is attached to bottom end 24*a* of second side piece 16 of primary frame 12. The ends of the side support cords can be attached by well-known means of attachment such as by being passed through apertures in the side pieces and knotted thereto or therebelow with knots larger than said apertures.

A first low-friction attachment means is attached to bottom 44 of hanger bar 36 adjacent to first end 40 with first side support cord 52 passing therethrough. The first low-friction attachment means, therefore, supports first side support cord 52 on hanger bar 36 yet allows first side support cord 52 to freely pass therethrough. A second low-friction attachment means is similarly attached to second side support cord 56 to bottom 44 of hanger bar 36 adjacent to second end 42 yet allows second side support cord 56 to pass freely therethrough. The low-friction attachment means allow first and second side support cords 52 and 56 to be moved on hanger bar 36, thereby adjusting the angle of incline of primary frame 12.

As seen in FIG. 1, first and second low-friction attachment means comprise, respectively, first pulley 60 and second pulley 60*a* which allow a user to adjust the angle of incline of primary frame 12 while actually being seated in hanging chair 10.

Further seen in FIG. 1 is front first side stop cord 70 which is attached to bottom 44 of hanger bar 36 between first pulley 60 and aperture 38 and which adjustably attaches to first side support cord 52 between second end 54*a* of first side support cord 52 and first pulley 60. Similarly, front second side stop cord 72 is attached to bottom 44 of hanger bar 36 between aperture 38 and second pulley 60*a* and adjustably attaches to second side support cord 56 between second end 58*a* of second side support cord 56 and second pulley 60*a*. Front stop cords 70 and 72 prevent primary frame 12 from rotating forward beyond a preselected point determined by where front stop cords 70 and 72 are attached, respectively, to first and second side support cords 52 and 56.

A back first side stop cord 74 attaches to bottom 44 of hanger bar 36 adjacent to front first side stop cord 70 and adjustably attaches to first side support cord 52 between first end 54 of first side support cord 52 and first pulley 60. A back second side stop cord 76 attaches to bottom 44 of hanger bar 36 adjacent to front second side stop cord 72 and adjustably attaches to second side support cord 56 between first end 58 of second side support cord 56 and second pulley 60*a*. Back stop cords 74 and 76 prevent primary frame 12 from rotating backward beyond a preselected point determined by where back stop cords 74 and 76 are attached, respectively, to side support cords 52 and 56.

As shown, each of stop cords 70, 72, 74 and 76 are attached to their respective side support cords 52 and 56 by tying stop cords 70, 72, 74 and 76 into Prussick-type slip knots around side support cords 52 and 56. The slip knots can then be loosened to move the stop cords along their respective side support cords. The stop cords are attached to hanger bar 36 by being passed therethrough and knotted.

Figure 2:
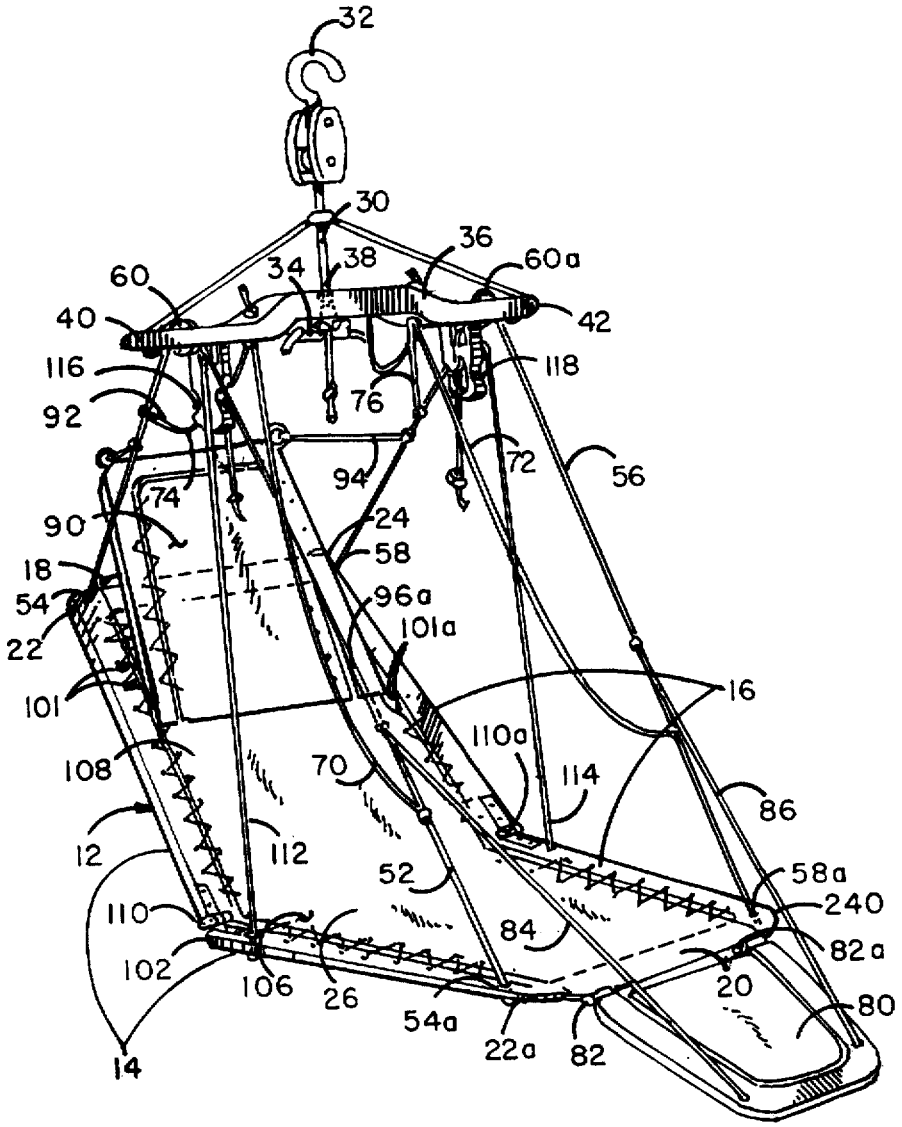
FIG. 2 illustrates a perspective side view of a second embodiment of the hanging chair of this invention.

FIG. 2 illustrates a second embodiment of the hanging chair of this invention denoted by numeral 10*a*, additionally including seat portion 106 back portion 108 of original primary frame 12, headrest 90 and footrest 80, and first and second central support cords 112 and 114.

First and second side pieces 14 and 16 of original primary frame 12 respectively include further a similarly located first and second breaks 102 and 104 between their respective top ends 22 and 24 and bottom ends 22*a* and 24*a*. The portion of original primary frame 12 between first and second breaks 102 and 104 and top piece 18 forms back portion 108 of primary frame 12; and the portion of primary frame 12 between first and second breaks 102 and 104 and bottom piece 20 forms seat portion 106, with seat portion 106 pivotally connected to back portion 108 by first and second primary hinges 110 and 110*a*.

First central support cord 112 attaches to first side piece 14 of seat portion 106 by being passed therethrough and knotted. A first adjustable attachment means adjustably attaches first central support cord 112 to bottom 44 of hanger bar 36. Similarly, second central support cord 114 attaches to second side piece 16 of seat portion 106 by being passed therethrough and knotted. A second adjustable attachment means adjustably attaches second central support cord 114 to bottom 44 of hanger bar 36, whereby first and second central support cords 112 and 114 can be raised or lowered to control the relative angle of incline between seat portion 106 and back portion 108 of primary frame 12.

Figure 3:
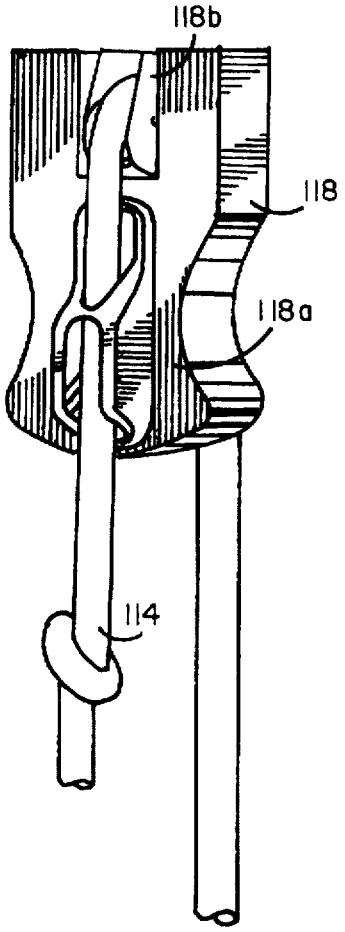
FIG. 3 illustrates a perspective side view of a jam cleat attachment member.

As illustrated in FIG. 2, first and second adjustable attachment means comprise, respectively, first and second jam cleat attachment members 116 and 118. As shown further in FIG. 3, second jam cleat attachment member 118 includes second jam cleat 118*a* and second jam pulley 118*b*. First jam cleat attachment member 116 also includes a first jam cleat and a first jam pulley, not seen in FIG. 2. Second central support cord 114 can be raised or lowered by first pulling the cord out from within second jam cleat 118*a* and then raising or lowering cord 114 over second jam pulley 118*b*. When cord 114 is raised or lowered to a preferred position, then cord 114 is pushed back into second jam cleat 118*a* which holds cord 114 therein and prevents it from moving up or down. First jam cleat attachment member 116 operates in a similar manner. First and seond jam cleat attachment members 116 and 118 allow a user to adjust the relative angle of incline between back portion 108 and seat portion 106 of primary frame 12 while actually being seated in hanging chair 10.

The embodiment of FIG. 2 additionally includes foot rest 80 and head rest 90. First foot rest support loop 84 is adjustably attached to first side support cord 52 between first pulley 60 and front side stop cord 70. Second foot rest support loop 86 is adjustably attached to second side support cord 56 between second pulley 60*a* and front second stop cord 72, whereby the first and second foot rest support loops support the user's feet on foot rest 80. First and second foot rest support loops 84 and 86 are also adjustably attached, respectively, to first and second side support cords 52 and 56 by being tied therearound in slip knots.

Foot rest 80 is pivotally connected to bottom piece 20 by first and second foot rest hinges 82 and 82*a* with first and second foot rest support loops 84 and 86 attached to foot rest 80. Foot rest 80 can have its own frame and sheet of material, with first and second foot rest support loops 84 and 86 passed through the foot rest frame and knotted.

Hanging chair 10*a* also includes head rest 90 and head rest attachment means for removably, adjustably and pivotally attaching head rest 90 to back portion 108 so that head rest 90 generally lies above top piece 18 of back portion 108. Head rest 90 can have its own frame and sheet of material, but the head rest sheet of material can include padding to make the head rest into a sort of pillow.

First head rest support cord 92 is adjustably attached to first side support cord 52 below back first side stop cord 74 and first end of first side support cord 54 and is removably attached to head rest 90. Second head rest support cord 94 is adjustably attached to second side support cord 56 below back second side stop cord 76 and first end of second side support cord 58 and is removably attached to head rest 90. Head rest support cords 92 and 94 are also adjustably attached to their respective side support cords 52 and 56 by being tied therearound in slip knots.

As seen in FIG. 2 head rest attachment means comprises first peg 96 and second peg 96*a* located on head rest 90; a plurality of head rest peg receiving holes 101 located on first side piece 14 of primary frame 12, each receiving hole 101 capable of slideably and rotatably receiving first peg 96; and a plurality of head rest peg receiving holes 101*a* located on second side piece 16 of primary frame 12, each receiving hole 101*a* capable of slideably and rotatably receiving second peg 96.

Figure 6:
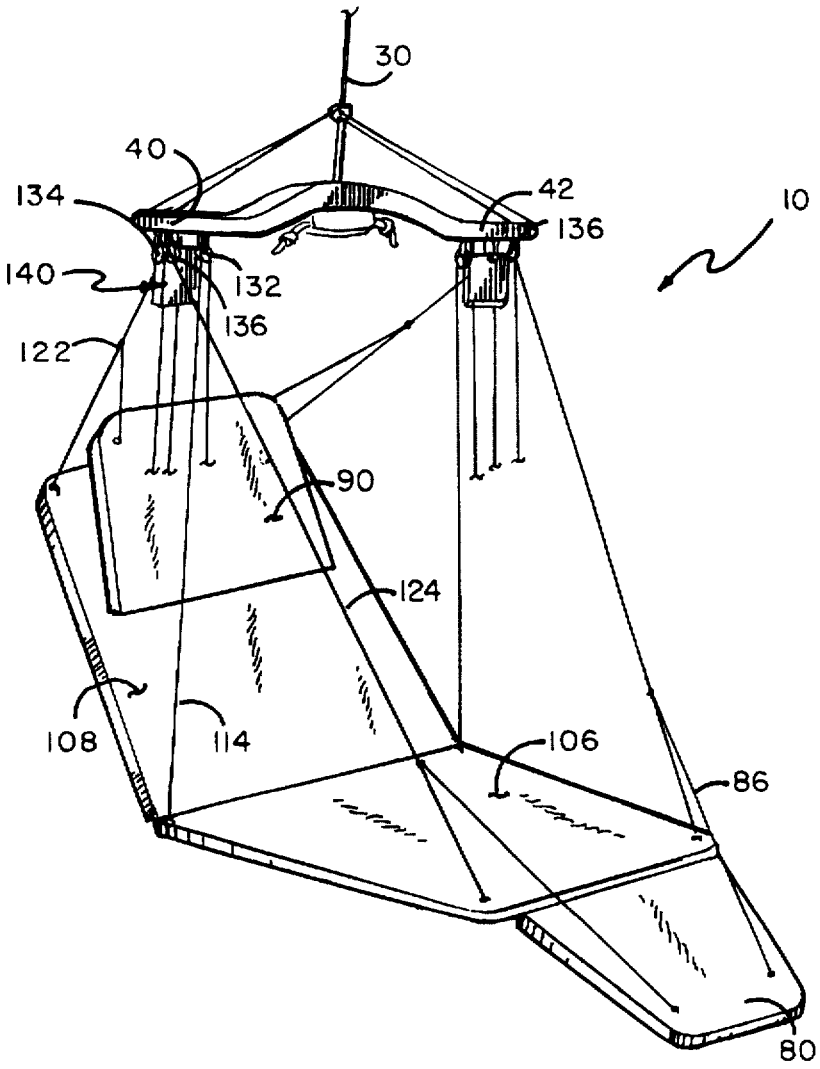
FIG. 6 illustrates a perspective view of a third embodiment of the hanging chair of this invention.

FIG. 6 illustrates a perspective side view of a third embodiment of the hanging chair of this invention with separate adjustability of the adjustment cords as described below.

Figure 5:
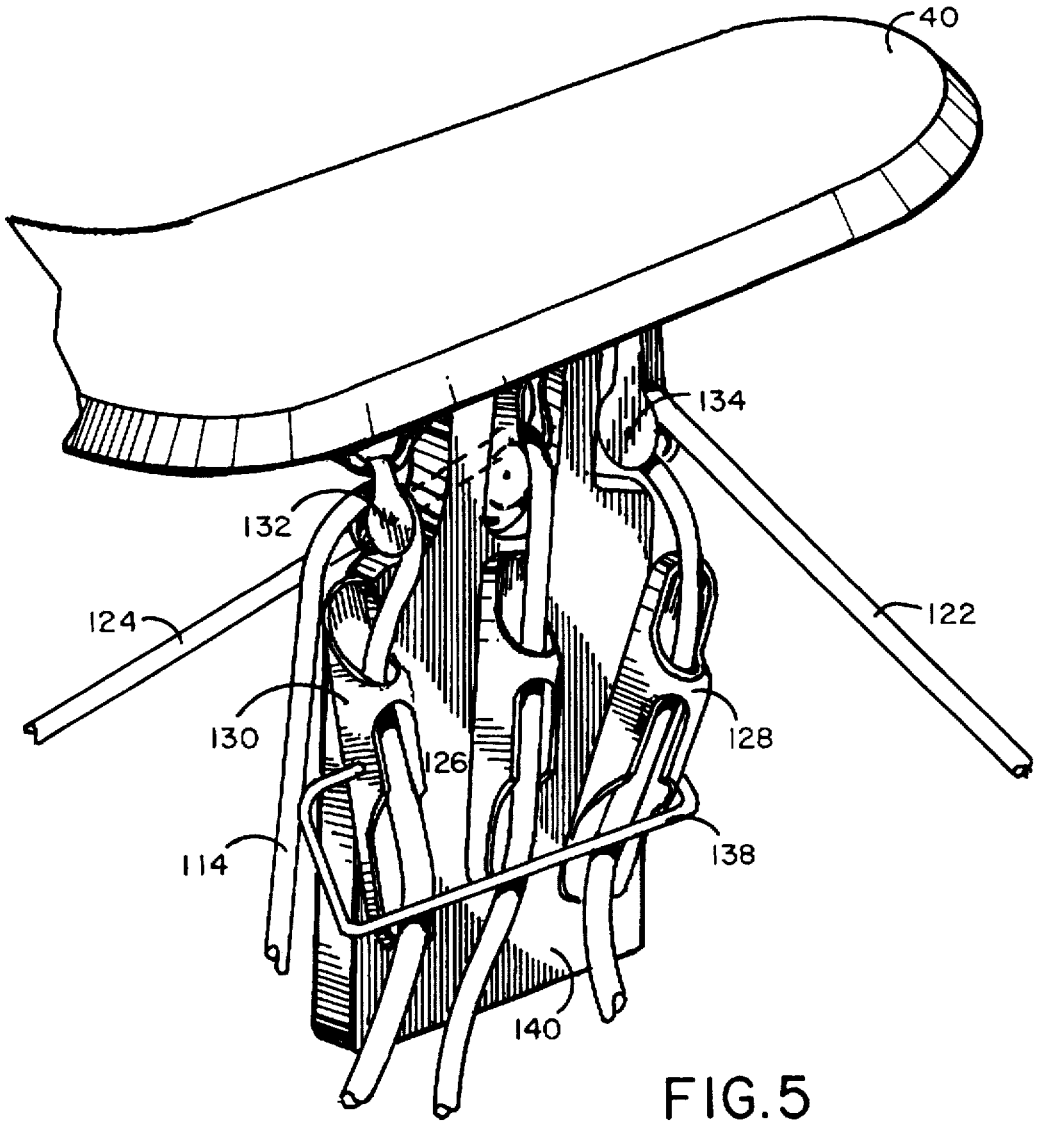
FIG. 5 illustrates a rear perspective view of a multiple jam cleat attachment member.

FIG. 5 illustrates an enlarged rear perspective view of first support member 140 of the alternate embodiment of the invention as seen in FIG. 6 wherein the side support cord is in two parts: the first cord portion extends to the back portion and the second cord portion extends to the seat portion which cord portions are adjustable in length independently of one another. At the same time each central support cord is also independently adjustable. The independent adjustability of the first support cord extending from the hanger bar to the upper portion of the back portion and of the second support cord extending from the hanger bar to the front portion of the seat portion adds infinite flexibility to the adjustments possible when using the hanging chair of this invention. As seen in FIG. 5 first support member 140 is shown disposed under the first end of hanger bar 40. A similar second support member, but constructed in mirror image, is disposed under the second end of hanger bar 42 and is not seen in this view. The first central support cord 114 extends around inner pulley 132 and down into inner jam cleat 130 where it can be pushed in place and locked in position at a length for the desired seat position of the user. First front support cord 124, extends from where the second end 54*a* of the first side support cord 52 would be otherwise attached to the back frame and passes around middle pulley 136 and extends down into middle jam cleat 126. The user can manipulate first front support cord 124 and its complementary cord on the opposite support member, not seen in this view, to raise or lower the front of the seat portion independently of the back portion and independently of the center of the hanging chair. First back support cord 122 extends from what would otherwise be the point of attachment of the first side support cord 52 at its first end 54 at the far end of the seat back, over outer pulley 134 and down into outer jam cleat 128 where it is retained in the desired position. By adjusting the position of the first back support cord 122 and its complementary cord on the support member on the second end of the hanger bar, not shown in this view, the user can independently adjust the angle of the back from the seat portion of the hanging chair. A catch member 138 can extend over the base of each of jam cleats 126, 128 and 130 to help prevent the cords from being inadvertently pulled out of the catch portion of each of the jam cleats. By using a support member, such as 140, on each end of the hanger bar, one can have independent adjustment of the back, the seat front and the rear of the seat to further adjust the chair into any desired position.

Many variations can be made in the exact structure described and illustrated herein without departing from the true spirit of the present invention. Although cords are shown throughout the invention, other well-known support means and attachment means can be substituted therefor. Also, instead of using hinges 82, 82*a*, 110 and 110*a*, other pivoting means can be substituted therefor to allow the respective angles of incline of back portion 108, seat portion 106 and foot rest 80 to be adjusted. Also, multiple breaks with corresponding adjustment cords can be incorporated into the primary frame for even greater adjustability. Additionally, primary frame 12 and the frames of back portion 108, head rest 90, seat 106 and foot rest 80 can have a more artistic design utilzing, for example, glue lamination for a more aesthetic, natural look.

Although the present invention has been described with reference to particular embodiments, it will be apparent to those skilled in the art that variations and modifications can be substituted therefor without departing from the principles and spirit of the invention.

I claim:

1. A hanging chair in combination with an overhead support for supporting a user in a reclined seated position, comprising:

a substantially rectangular primary frame having a first side piece, a second side piece, a top piece having sides and a bottom piece having sides, said first and second side pieces having, respectively, a top end and a bottom end, said primary frame having a substantially rectangular sheet of material disposed stretching between and attached to said side pieces and said top and bottom of said primary frame, said first side piece including a first break located between said top end and said bottom end of said first side piece; said second side piece including a second break located between said top end and said bottom end of said second side piece, the portion of said primary frame disposed between said top piece and said first and second breaks forming a back portion of said primary frame, the portion of said primary frame disposed between said bottom piece and said first and second breaks forming a seat portion of said primary frame, said primary frame further including first and second primary hinges pivotally connecting said seat portion to said back portion;

hanging means removably attached to said overhead support;

a chair support cord attachable to said hanging means;

a hanger bar having an aperture defined generally centrally therein, said hanger bar having a first end, a second end, and a bottom;

adjustable securing means attached to said bottom of said hanger bar adjacent to said aperture, said chair support cord extending through said aperture with said securing means adjustably securing said hanger bar to said chair support cord, whereby the vertical height of said hanger bar can be adjusted up or down along said chair support cord;

a first central support cord passing through said first side piece of said primary frame adjacent to its bottom end and knotted;

a second central support cord passing through said second side piece of said primary frame adjacent to its bottom end and knotted;

a first adjustable attachment means for adjustably attaching said first central support cord to said hanger bar, said first adjustable attachment means attached to said bottom of said hanger bar at said first end of said hanger bar;

a second adjustable attachment means for adjustably attaching said second central support cord to said hanger bar, said second adjustable attachment means attached to said bottom of said hanger bar at said second end of said hanger bar;

first and second front side support cords each having a first end and a second end, said first end of each of said first and second front side support cords passed through respective sides of said bottom piece of said primary frame and knotted, and said second ends of said first and second front side support cords adjustably attached, respectively, to said first and second adjustable attachment means; and first and second rear side support cords, each having a first end and a second end, said first ends passed through the sides of said top piece of said primary frame and knotted and said second ends of said first and second rear side support cords adjustably attached, respectively, to said first and second adjustable attachment means whereby said central support cords and front and rear side support cords can be raised or lowered to control the relative angle of incline between said seat portion and said back portion and the height of said hanging chair.

2.The combinations of claim 1 further including:

a foot rest pivotally connected to said primary frame adjacent to said bottom piece of said primary frame; and first and second foot rest hinges pivotally connecting said foot rest to said primary frame; and means to adjust the angle of incline of said foot rest relative to said seat portion of said primary frame.

3. The combinations of claim 2 further including:

a head rest;

head rest attachment means for removably, adjustably and pivotally attaching said head rest to said back portion so that said head rest lies above said top piece of said primary frame; and means to adjust the angle of incline of said head rest.

4. The combinations of claim 3 wherein said adjustable securing means for adjustably securing said hanger bar to said chair support cord comprises a cam cleat attachment having a pair of side-by-side, oppositely oriented cam rollers, said cam cleat attachment attached to the bottom of said hanger bar with said chair support cord passing between said cam rollers, said cam rollers securing said chair support cord therebetween.

5. The combinations of claim 4 wherein said first and second adjustable attachment means each comprise, respectively, a first, a second and a third jam cleat attachment, said first jam cleat attachment having a first jam pulley and a first jam cleat, said first jam cleat attachment attached to said hanger bar with said first central support cord passing through said first jam pulley and being secured within said first jam cleat, said second jam cleat attachment having a second jam pulley and a second jam cleat, said second jam cleat attachment attached to said hanger bar with said front side support cord passing through said second jam pulley and being secured within said second jam cleat, said third jam cleat attachment attached to said hanger bar and having a third jam pulley and a third jam cleat with said rear side support cord passing through said third pulley and being secured within said third jam cleat.

6. The combination of claim 5 wherein said head rest attachment means comprise:

a first peg and a second peg, said first and second pegs located on said head rest;

a plurality of head rest peg receiving holes defined in a first side piece of said back portion of said primary frame, said head rest peg receiving holes capable of slideably and rotatably receiving said first peg; and a plurality of head rest peg receiving holes defined in a second side piece of said back portion of said primary frame, said head rest peg receiving holes capable of slideably and rotatably receiving said second peg.

* * * * *